US005915474A

United States Patent [19]

Buytaert et al.

[11] Patent Number: 5,915,474

[45] Date of Patent: Jun. 29, 1999

[54] MULTIPLE DRAIN DRILLING AND PRODUCTION APPARATUS

[75] Inventors: Jean Buytaert, Newtonill; Roland Wessel, Bieldside, both of United Kingdom

[73] Assignee: Integrated Drilling Services Limited, United Kingdom

[21] Appl. No.: 08/894,594

[22] PCT Filed: Feb. 1, 1996

[86] PCT No.: PCT/GB96/00233

§ 371 Date: Oct. 23, 1997

§ 102(e) Date: Oct. 23, 1997

[87] PCT Pub. No.: WO96/23953

PCT Pub. Date: Aug. 8, 1996

[30] Foreign Application Priority Data

Feb. 3, 1995 [GB] United Kingdom ..... 9502190
Nov. 17, 1995 [GB] United Kingdom ..... 9523590

[51] Int. Cl.[6] ..... E03B 3/11

[52] U.S. Cl. ..... 166/50; 166/117.6; 175/61; 175/62; 175/81; 175/82

[58] Field of Search ..... 166/50, 117.5, 166/117.6, 242.1, 382; 175/61, 62, 81, 82

[56] References Cited

U.S. PATENT DOCUMENTS 2,397,070 3/1946 Zublin .
4,007,797 2/1977 Jeter ..... 175/26
4,573,541 3/1986 Josse et al. ..... 175/78
4,693,327 9/1987 Dickinson et al. ..... 175/61
5,193,620 3/1993 Braddick ..... 175/81 X
5,423,387 6/1995 Lynde ..... 166/117.5 X
5,458,209 10/1995 Hayes et al. ..... 175/61
5,462,120 10/1995 Gondouin ..... 166/117.6 X

FOREIGN PATENT DOCUMENTS 574326 12/1993 France .

*Primary Examiner*—Roger Schoeppel
*Attorney, Agent, or Firm*—Jones & Askew, LLP

[57] ABSTRACT

Multiple drain drilling and production apparatus (16) comprising a generally cylindrical body (18) adapted to be located within a well, and an orienting assembly (24, 28) adapted to be received in the body (18) to deviate a drill string received within the body, at a predetermined depth, from a path coaxial with the body to a path at a predetermined angle to the axis of the body. The apparatus comprises at least one outlet (20) comprising a generally tubular element (42) received within the body and opening thereinto and displaceable from a first position generally coaxial with the body, into a second position at a predetermined angle thereto, by an actuator (200) received within the body, the orienting assembly being located adjacent the outlet (20).

13 Claims, 10 Drawing Sheets

MULTIPLE DRAIN DRILLING AND PRODUCTION APPARATUS

FIELD OF THE INVENTION

The present invention relates to a multiple drain drilling and production apparatus and, more particularly, to such an apparatus adapted for drilling multiple drains from a single well.

BACKGROUND OF THE INVENTION

In the field of oil production it is common practice to drill a number of branched, lateral wells or drains from a single master well. Such a technique is used for both technical and economic reasons.

Lateral wells drilled from a single, master well enable the oil-containing strata to be reached at a number of points, so increasing both the rate and the volume of production. Furthermore, the use of such a technique offers economic advantages as the lateral wells all share a common well-head and production outlet.

Another use of such drains is to make it possible to work strata having a large number of fractures. The drains each intercept a number of fractures and connect them to the drainage system of the master well.

Lateral drains are typically drilled from the master well at a point some distance below the surface by using a device known as a whipstock. This is a tool which serves to deviate the drillstring from the axis of the master well on to a new predetermined course. Having drilled a first lateral drain, the drillstring is removed and the whipstock is turned to a new orientation and depth within the well so as to deviate the drillstring, once it is returned within the well, on to a new course at a predetermined path relative to both the master well and the first drain.

The document U.S. Pat. No. 4,573,541 describes a device of this type. In particular, this document describes a drilling and petroleum production start-up device consisting of a master well and at least one branched well opening into the master well, and comprising an outer tube located in the master well, and at least one take-off assembly fastened in situ in the outer tube and at least one fixed take-off tube, the lower end of which communicates with a branched well. Typically, this device is adapted for drilling three branched wells from the master well.

While this device enables several branched wells to be simply drilled from a master well, it does present certain disadvantages. Specifically, as the three take-off tubes are arranged side by side, their diameters are necessarily small in relation to that of the master well. Similarly, should the diameter of the take-off tubes be required to be large, there is a corresponding increase in the dimensions of the whole device.

The document EP-A-0 574 326 describes a device enabling a lateral well to be drilled from a master well which comprises a curved surface arranged within the device and intended to deviate a drillstring onto a predetermined path, the drillstring passing through an opening formed in the wall of the device. However, this device does not resolve the problem of ensuring a complete seal between the outer wall of the lateral well and that of the master well.

SUMMARY OF THE INVENTION

The object of the present invention is to provide a multiple drain drilling apparatus which enables several drains to be simply drilled from a master well, while being of relatively small dimensions, and allowing the diameter of each drain to be relatively large compared to that of the master well.

According to the invention there is provided a multiple drain drilling and production apparatus comprising a generally cylindrical body adapted to be located within a well, orienting means adapted to be received in the body to deviate a drill string received within the body, at a predetermined depth, from a path coaxial with the body to a path at a predetermined angle to the axis of the body, characterised in that the apparatus comprises at least one outlet means comprising a generally tubular element received within the body and opening there into and displaceable, from a first position generally coaxial with the body, into a second position at a predetermined angle thereto, by an actuator received within the body, the orienting means being located adjacent the outlet means.

The wall of a well is generally sealed relative to the various layers of rock through which the well passes by a liner or casing. It is a further object of the invention to provide an apparatus which ensures that the intercommunication between the interior of the well and the, or each, drain remains sealed.

According to a preferred embodiment of the invention the body is formed with an opening for each outlet means, the apparatus further comprises seal means arranged around the opening between each outlet means and the body.

BRIEF DESCRIPTION OF THE DRAWINGS

The present invention will now be described by way of example only, with reference to the accompanying drawings in which.

DESCRIPTION OF THE PREFERRED EMBODIMENTS

Figure 1:
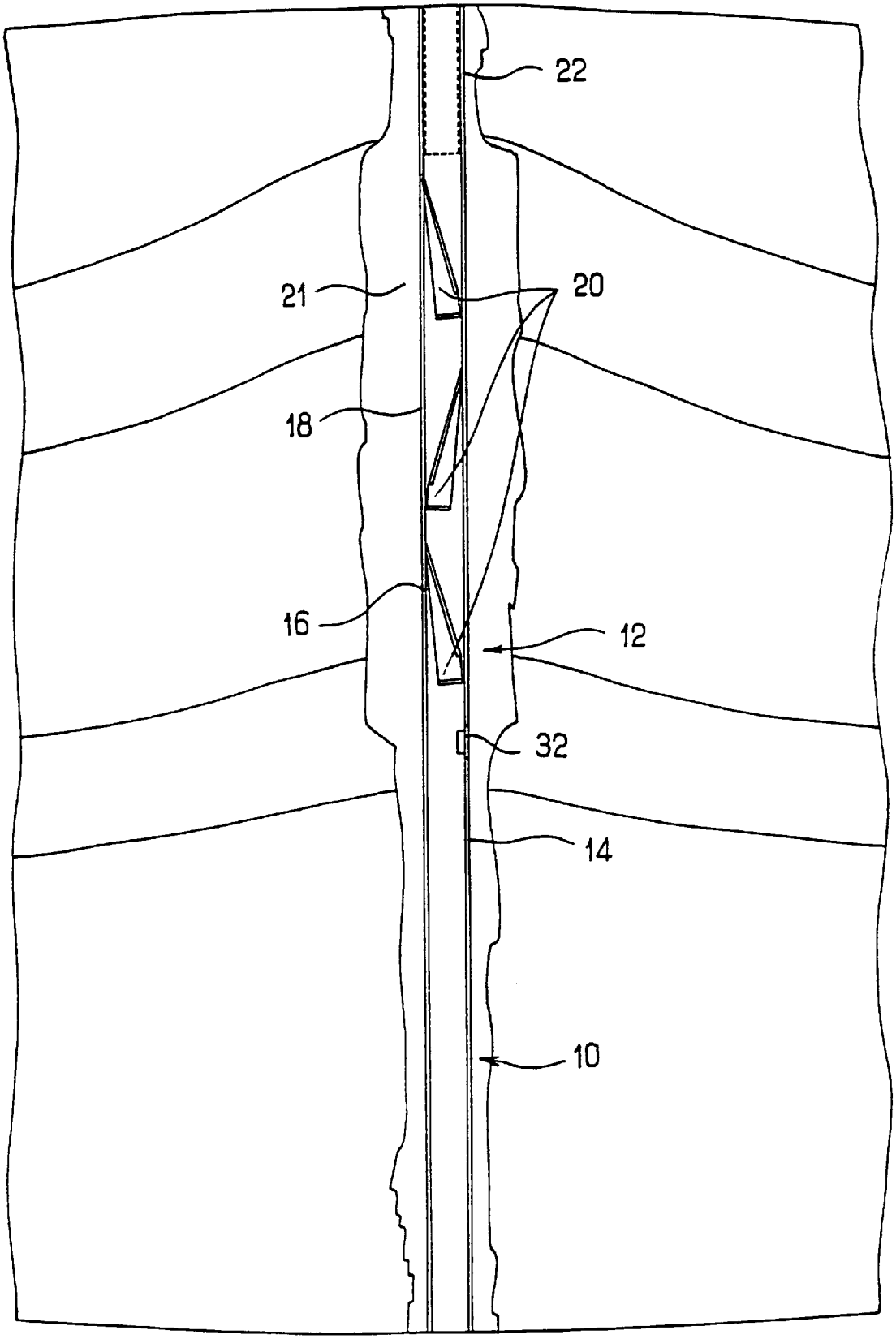
FIGS. 1, 2 and 3 are schematic longitudinal views of a multiple drain drilling and production apparatus according to the invention.
Figure 2:
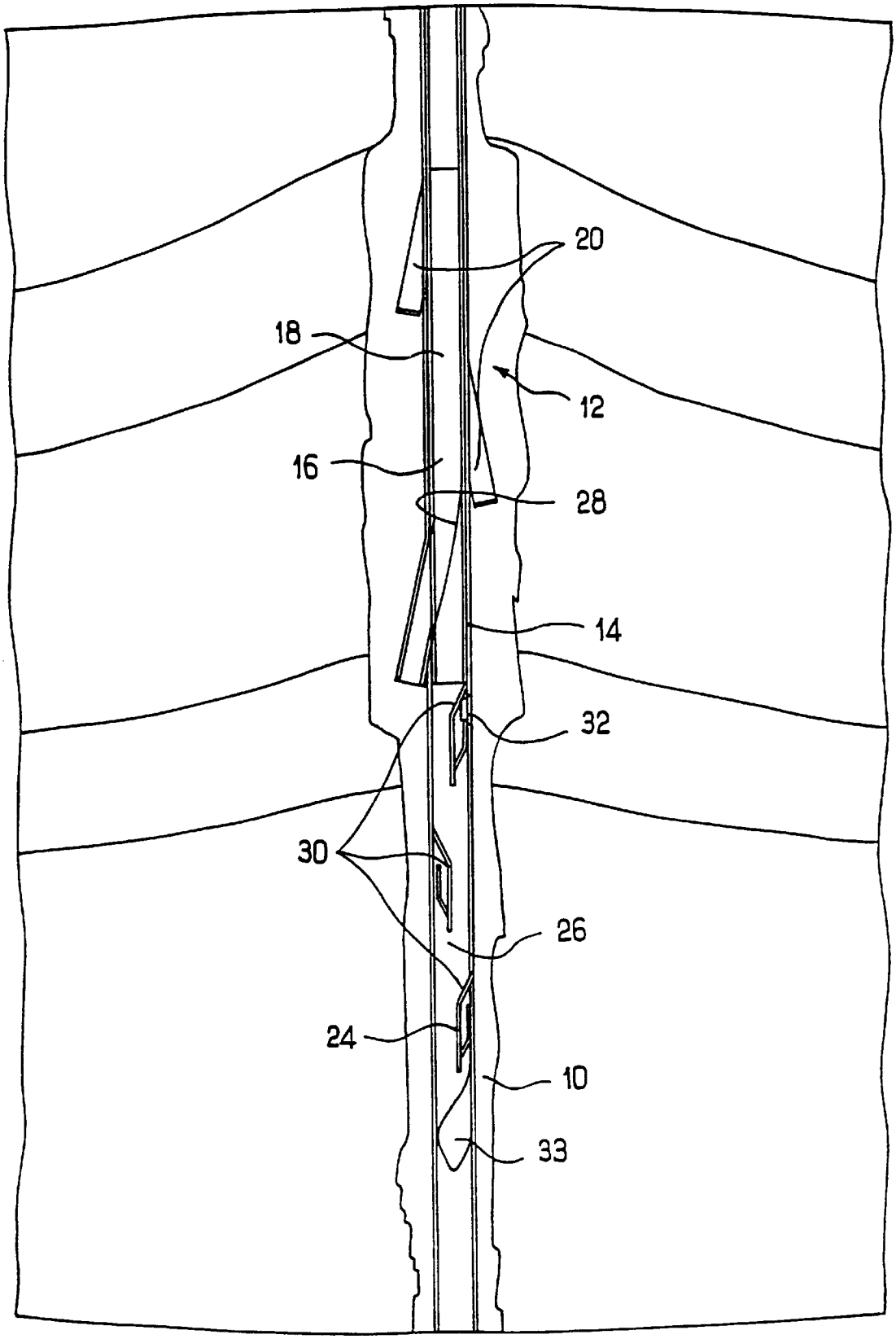

FIG. 1 is a cross sectional view of a well 10 which extends from the surface (not shown). After the well has been drilled in a conventional manner with a constant diameter along its length, the drillstring is removed and a reamer bit is substituted. An enlarged volume 12 is then reamed out, beyond the original diameter, above the point from which it is desired to start the lateral drain. The drillstring and reamer bit are then removed and a casing assembly 14 is lowered into the well 10. Adjacent the lower end of the casing assembly 14, or, in the case of multi-zone installations, at various points along the casing assembly, is mounted a multiple drain drilling apparatus 16 according to the invention. The apparatus comprises a generally cylindrical outer body 18 whose outer diameter is the same as that of the casing assembly. Within the apparatus 16 are arranged one or more tubular elements or outlets 20 which will be described in detail herebelow. Each outlet 20 is pivotally mounted at its upper edge on the outer body 18 and is displaceable from a first position, illustrated in FIG. 1, where it extends generally coaxially within the body 18, into a second, open position where it projects from the body at a predetermined angle thereto which is illustrated in FIG. 2.

When the apparatus is in the position shown in FIG. 1, a tubular actuator 22, shown in dashed lines in FIG. 1 is lowered within the casing 14. The outer diameter of the actuator 22 is slightly smaller than the interior diameter of the casing 14. As the actuator is lowered inside the body 18, it engages each of the outlets 20 in succession, moving them from their first position shown in FIG. 1 into their second, open position shown in FIG. 2. Each outlet may include a latching device to retain the outlet in its open position once the actuator is withdrawn.

Having moved the outlets 20 into their open position, the actuator is removed and a conventional cementing operation is carried out to fill the annular space 21 between the casing and the wall of the well with cement. The free ends of the outlets are closed in order to avoid entry of cement from the annular space.

In order for a drill string to be caused to deviate, during a subsequent drilling operation, down a selected one of the outlets 20, it is necessary to locate a whipstock in the body 18 at a point adjacent the outlet.

In FIG. 2 there is shown a orienting assembly 24 which comprises a longitudinally extending body 26, whose diameter corresponds to the inner diameter of the body 18, and whose upper end is formed with a whipstock 28 adapted to deviate a descending drill string into the adjacent outlet 20. The orienting assembly 24 may have a hollow bore to allow fluid communication therethrough. The location of the orienting assembly 24 at a given orientation and at a given level in the body 18 is ensured by a conventional orientation means known as a J-slot. In such a device, a J-shaped recess 30, formed on the outer surface of the orienting assembly 24 engages a locating lug 32 projecting from the inner wall of the body 18 at a predetermined position. The orienting assembly 24 comprises a locating device 33, more commonly known as a muleshoe, at its lower end to guide the locating lug 32 towards the first J-slot. In the illustrated embodiment there are three J-shaped recesses 30, one corresponding to each outlet.

When it is desired to drill a drain through a given outlet 20, the orienting assembly 24 is lowered into position by connventional means, for example on a drill pipe, where a preseletcted J-slot engages the lug 32. For example, when it is wished to drill a drain through the lowest outlet 20, the orienting assembly is located in the position shown in FIG. 2. Thus a descending drill string and bit will be deviated by the whipstock 28 into the outlet 20 and drill a drain 34 along a deviated path shown in FIG. 3.

It should be noted that the diameter of the drain 34 is relatively large compared to the internal diameter of the body 18, and is significantly larger than was the case with previously proposed apparatus.

Once drilled, the drain 34 is completed and cased with a liner 36 which is attached to the outlet 20 by a liner hanger 37 of conventional construction which thus establishes sealed communication between the cased drain 34 and the body 18. The liner 36 does not project into the interior of the body 18. Thus, the interior of the body remains clear for subsequent operations. The orienting assembly 24 is re-positioned after the drain has been completed and cased, in order to align the whipstock adjacent the next outlet to be drilled through. The re-positioning or actuation of the orienting assembly 24 relative to the body 18 is accomplished by vertical displacement of the orienting assembly by conventional means such as drill pipe, coiled tubing or wireline. Such means are attached to the top of the orienting assembly 24 by a releasable connecting tool (not shown). In an alternative embodiment, the repositioning or actuation of the whipstock may be carried out by a hydraulic ram located within the orienting assembly and actuated by a control line.

Figure 3:
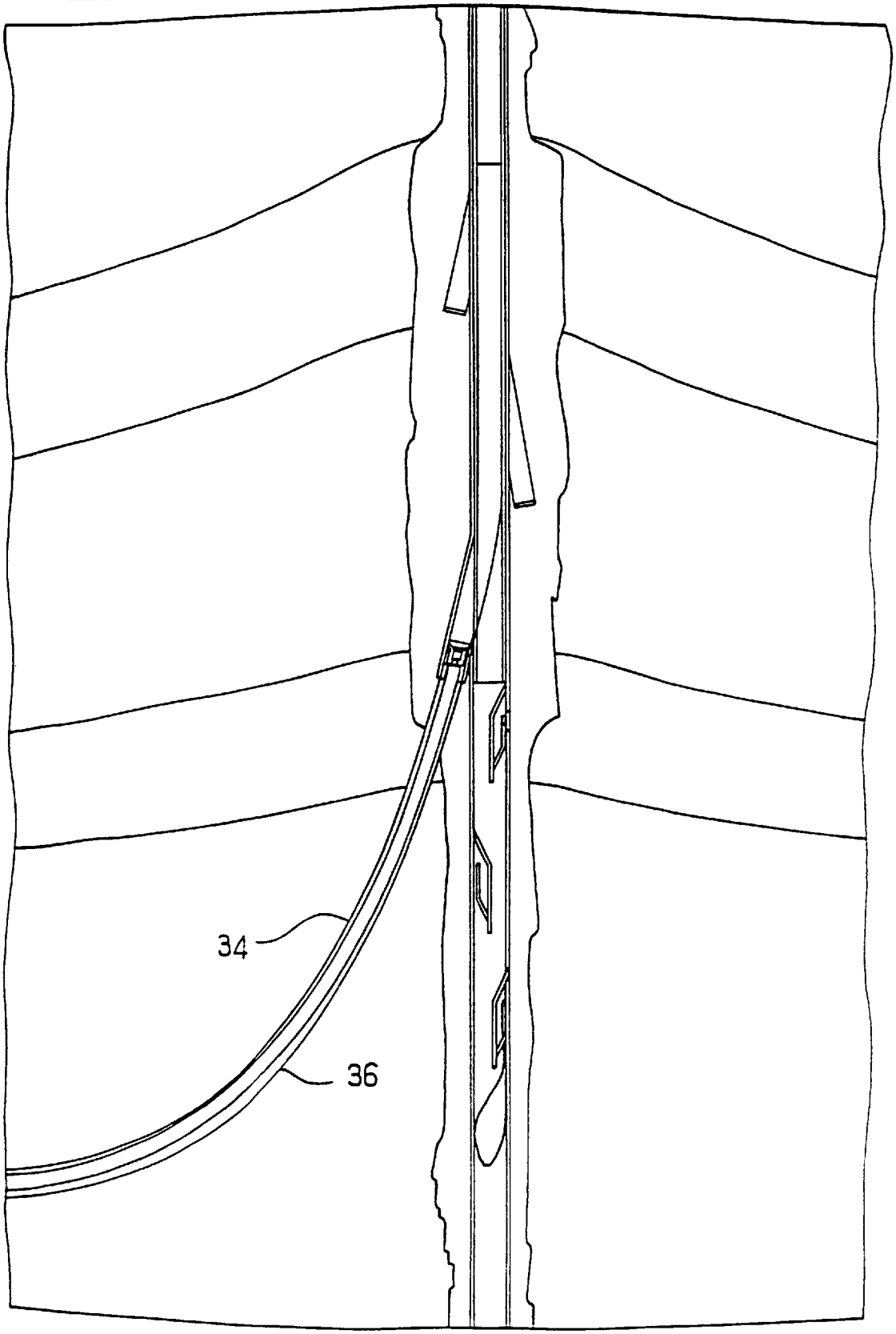

After the desired number of drain wells have been drilled and completed, the orienting assembly 24 may be actuated to position the whipstock 28 adjacent the drain wells previously drilled in order to remove previously installed plugs and thereby prepare the drain wells for production. The orienting assembly 24 may include seals arranged around the outside diameter of the body 26 in order to isolate the drain wells one from another during the actuation of the orienting assembly. In the embodiment of FIG. 3, the orienting assembly is arranged at the lower end of a drill string (not shown) which extends up to the surface. When the orienting assembly is in its illustrated lowest position, an intermediate, tubular element is located between the orienting assembly and the drill string so as to extend past the three outlets. The tubular element is formed with longitudinal slots thereby allowing all the drain wells to produce into the master well.

It should be noted that in the embodiment of FIG. 3, it is possible to remove the orienting assembly 24 from the body 18. Thus, it is possible to introduce production equipment into the master well after the drain wells have been drilled. Furthermore, it is possible, with this embodiment, to use the orienting assembly at any time to enable a drill string to re-enter any drain well.

Figure 4A:
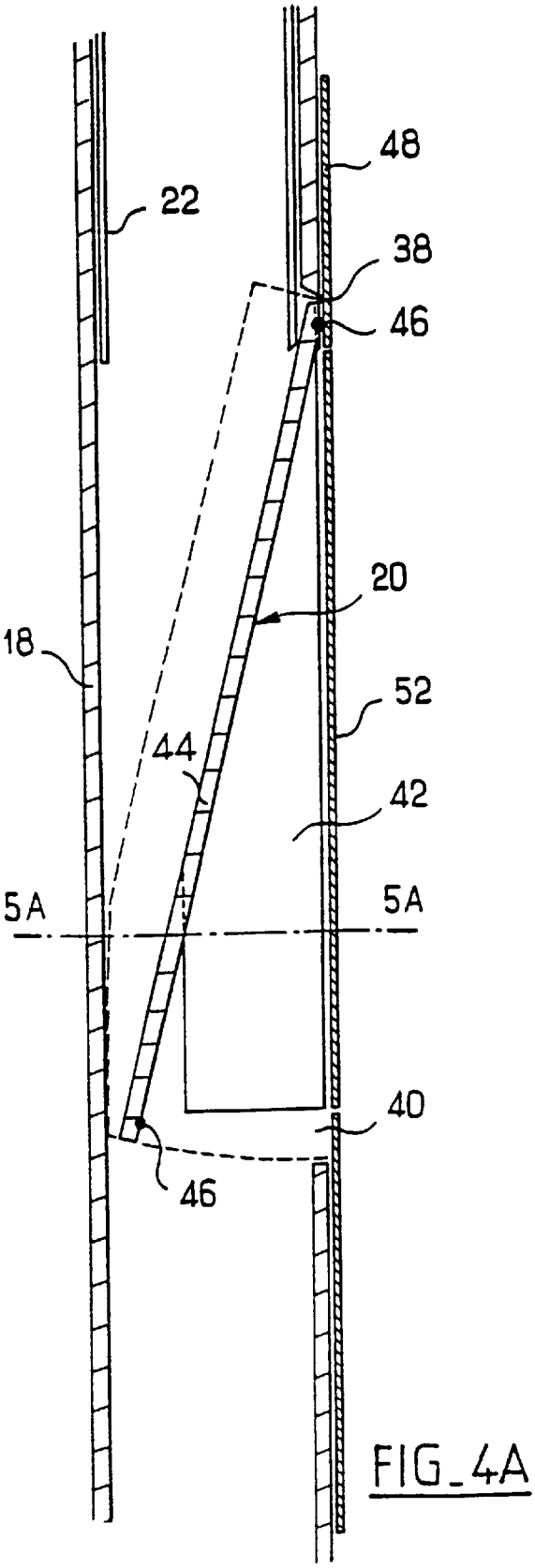
FIGS. 4*a* and 4*b* are schematic longitudinal sections of the device of FIGS. 1 to 3.
Figure 4B:
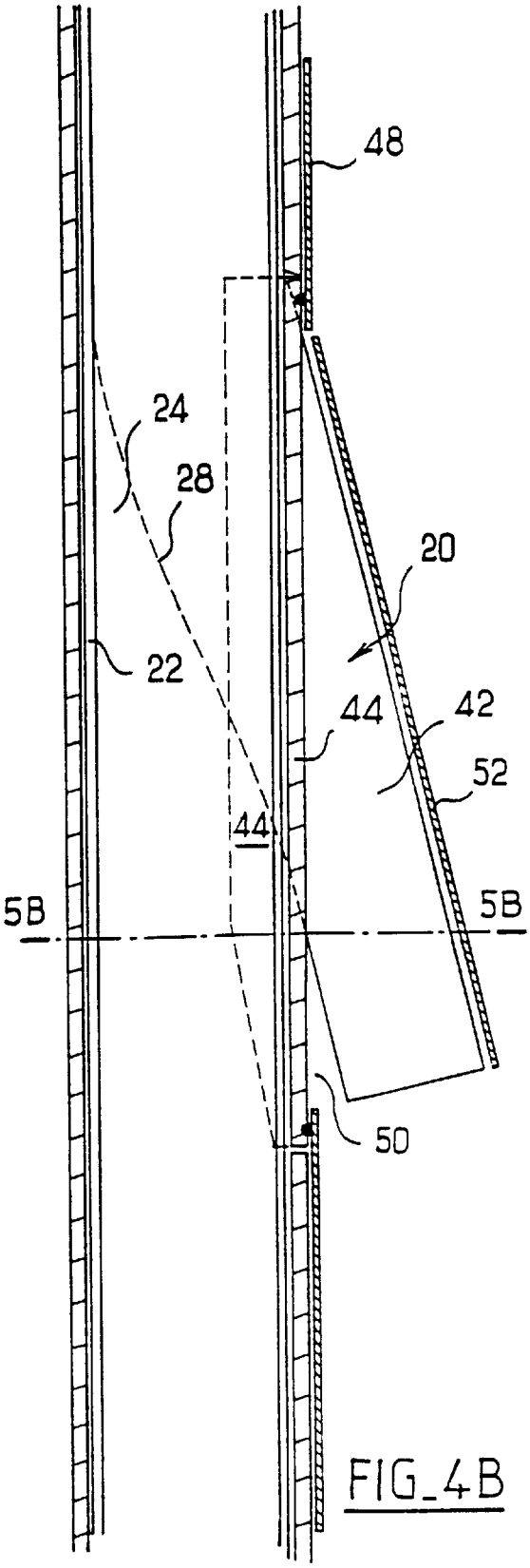
Figure 5A:
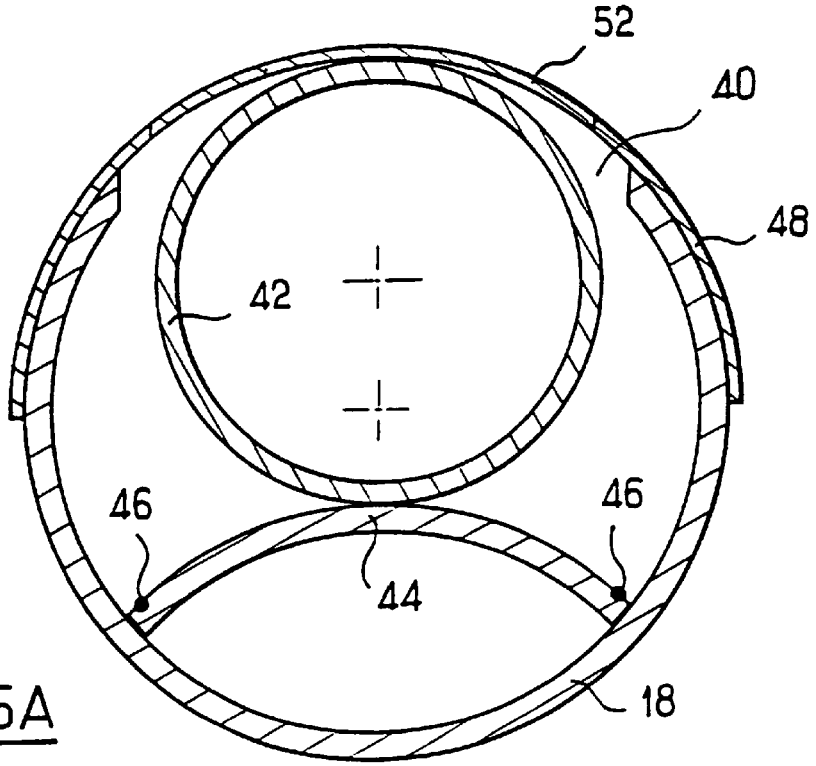
FIGS. 5*a* and 5*b* are cross sectional vie.:, taken along the lines 5*a*—5*a* and 5*b*—5*b* of FIGS. 4*a* and 4*b* respectively.
Figure 5B:
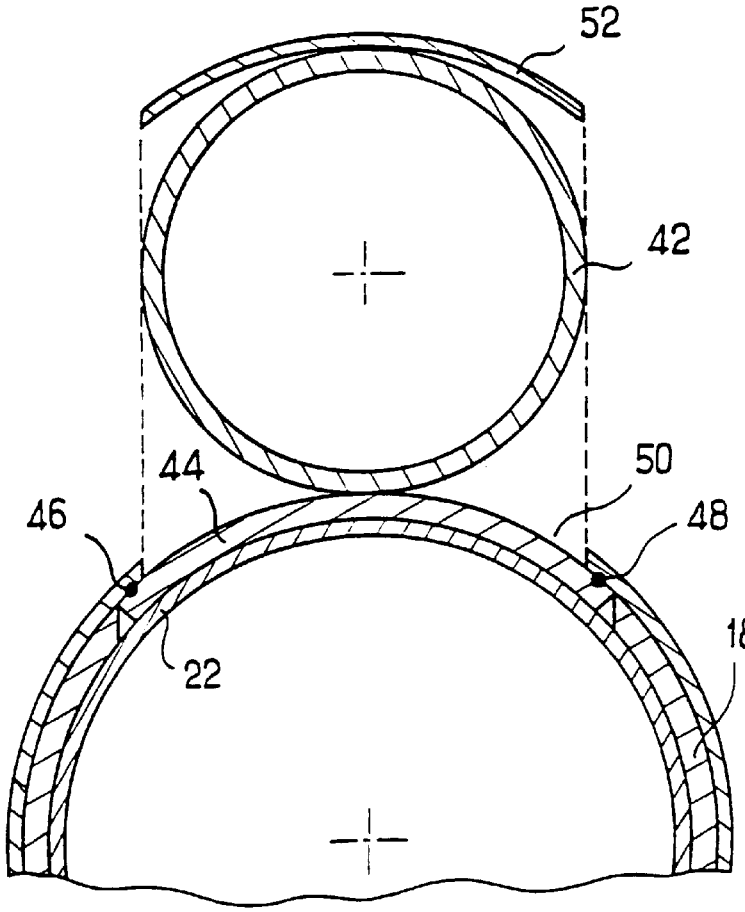

FIGS. 4 and 5 show details of the construction of an outlet 20 and the way in which it is mounted in the body 18 of the multiple drain drilling and production apparatus of the invention, FIGS. 4*a* and 5*a* showing the outlet in its closed position, and FIGS. 4*b* and 5*b* showing it in its open position.

In FIG. 4*a* there is shown, in section, the body 18 on which an outlet 20 is pivotably mounted by means of a hinge 38 at a point adjacent an opening 40 in the wall of the body. The outlet 20 comprises a generally tubular part 42 mounted on a support 44 whose shape and size correspond closely to those of the opening 40. The support is formed with an aperture corresponding to the intersection of the tubular part 42 and the support 44 so as to allow communication between the outlet and the interior of the body 18. A peripheral seal 46 is located in a recess formed around the edge of the support 44 and is formed of suitable material such as nitrile rubber or metal.

An outer casing 48 having a generally semi-circular cross section is mounted on the outer wall of the body 18 around the opening 40 and is itself formed with an opening 50 which is adapted to receive the outlet 20 when it moves into its open position. A closure member 52 corresponding to the shape and size of the opening 50 is attached to the outer surface of the tubular part 42. The outer casing 48 extends beyond the periphery of the opening 40. This is more clearly shown in FIGS. 5*a* and 5*b*.

Once the apparatus is in position within the well, the actuator 22 is lowered into the well until it engages the inner surface of the support. Further movement of the actuator 22 causes the outlet 20 to pivot from its position in FIG. 4*a* into its open position shown in FIG. 4*b*. In this open position, seal 46 comes into contact with the inner surface of the outer casing 48, so sealing the inside of the body 18 relative to the well. The actuator is then removed and the orienting assembly 24 is lowered into the well to locate the whipstock 28 in a position, adjacent the outlet 20, represented by dotted lines in FIG. 4*b*.

Figure 6:
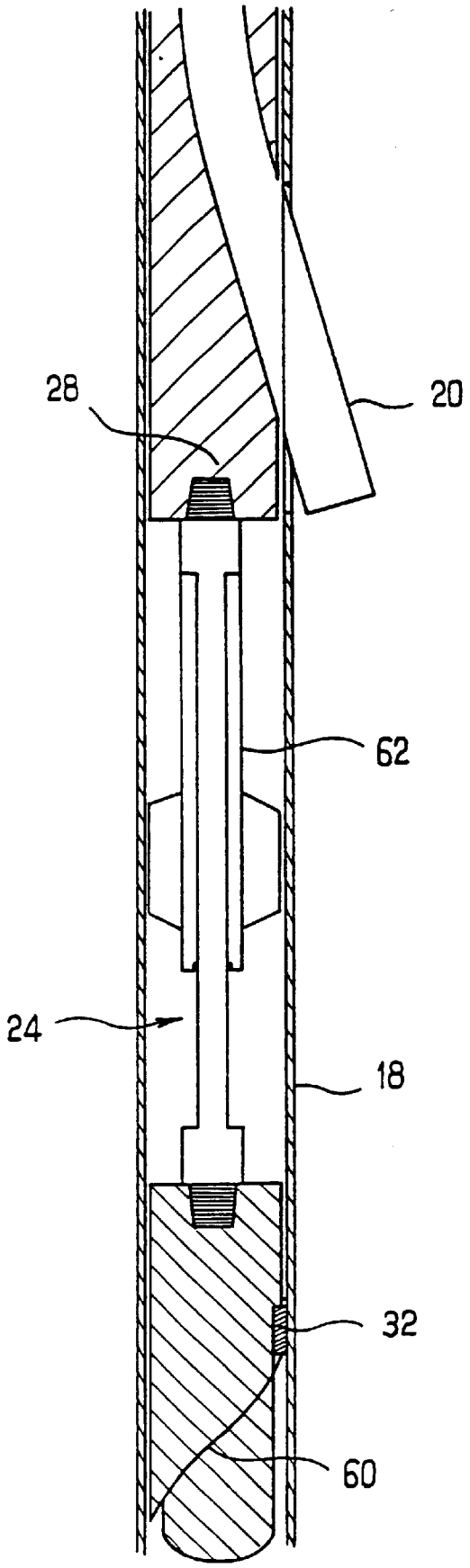
FIG. 6 is a schematic longitudinal section of an apparatus according to a second embodiment of the invention.

In some cases, such as where the apparatus is used in a deep horizontal well, the operation of the orienting assembly may be impeded by friction between it and the well. In such cases an alternative locating device for the whipstock is used which is illustrated in FIG. 6. This apparatus has a shorter overall length than that described above. As shown in FIG. 6, the orienting assembly 24 comprises a whipstock 28 which is connected to a separate locating element 60, or muleshoe, by a spacer 62 of predetermined length. The locating element 60 is adapted to seat itself on the locating lug 32 when the assembly is lowered into the well by any conventional means. The length of the spacer determines the distance between the whipstock 28 and the locating lug 32, and thus by selecting the length of the spacer 62 the whipstock can be located adjacent a chosen outlet. The descending drillbit will be deviated by the whipstock and drill a drain along a predetermined path. Subsequent drains can be drilled by selecting spacers of appropriate lengths and which locate the whipstock with an orientation corresponding precisely to that of the selected outlet.

In the embodiment described with reference to FIGS. 4 and 5, the outlet 20 is pivotally mounted within the body 18, and the resulting assembly forms part of the casing string being lowered into the well. An alternative embodiment to the above comprises an outlet which is constructed separately from the body. After the casing has been lowered into the well and located in position, the outlet would be run inside the casing with an adapted running tool, until it reaches a position adjacent a desired, pre-machined opening. Such an opening would be completely closed by a closure member. The sealed junction between the outer casing and the closure member would be made of a fissile material such as an epoxy resin. A special opening tool would then be used to laterally translate the outlet through the pre-machined opening, thus breaking the fissile material and pushing the closure member outwards relative to the outer casing.

Figure 7A:
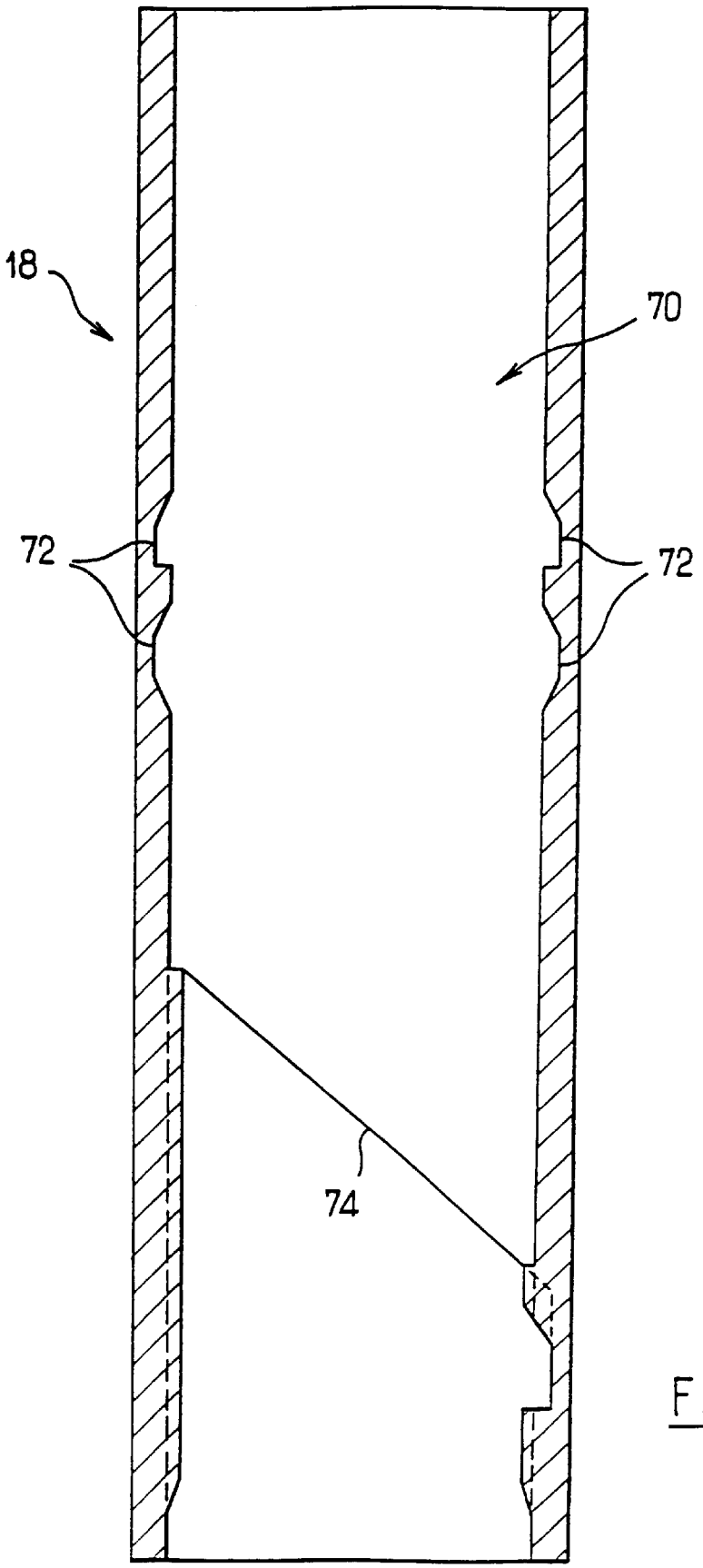
FIGS. 7*a*, 7*b* and 7*c* are schematic longitudinal sectional views of a second embodiment of an orienting assembly.
Figure 7B:
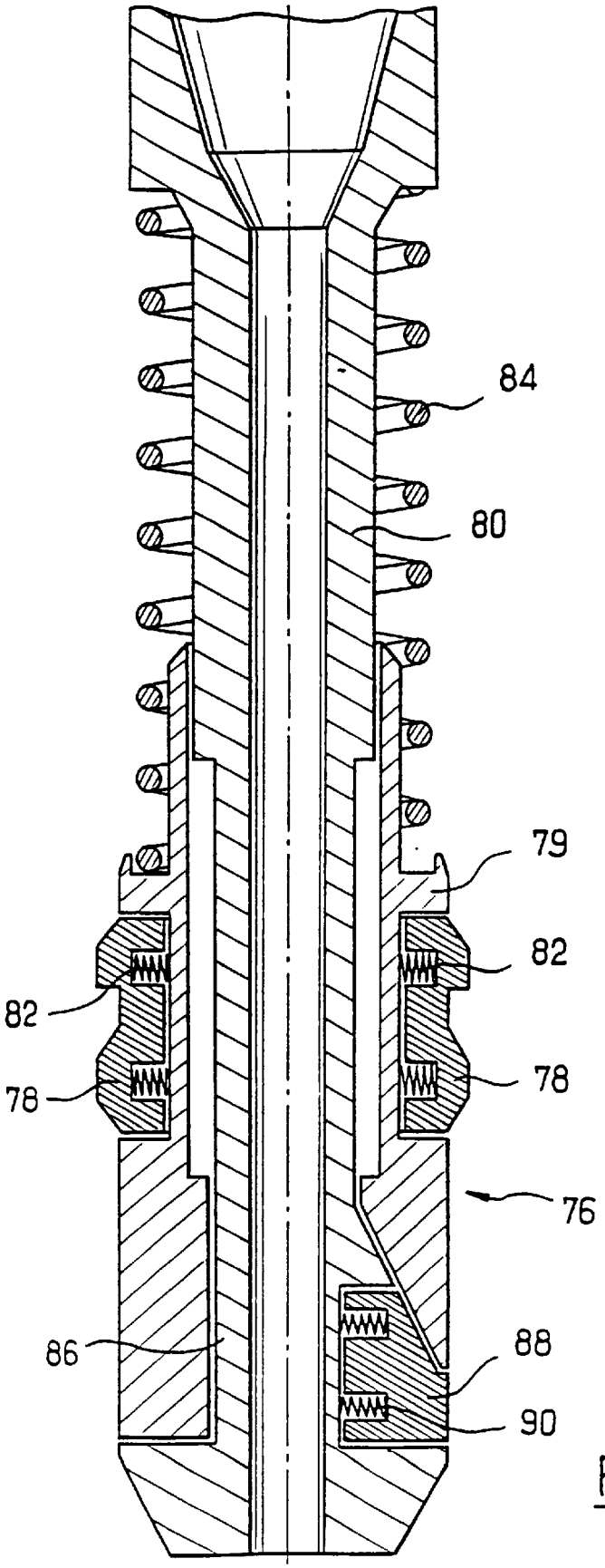
Figure 7C:
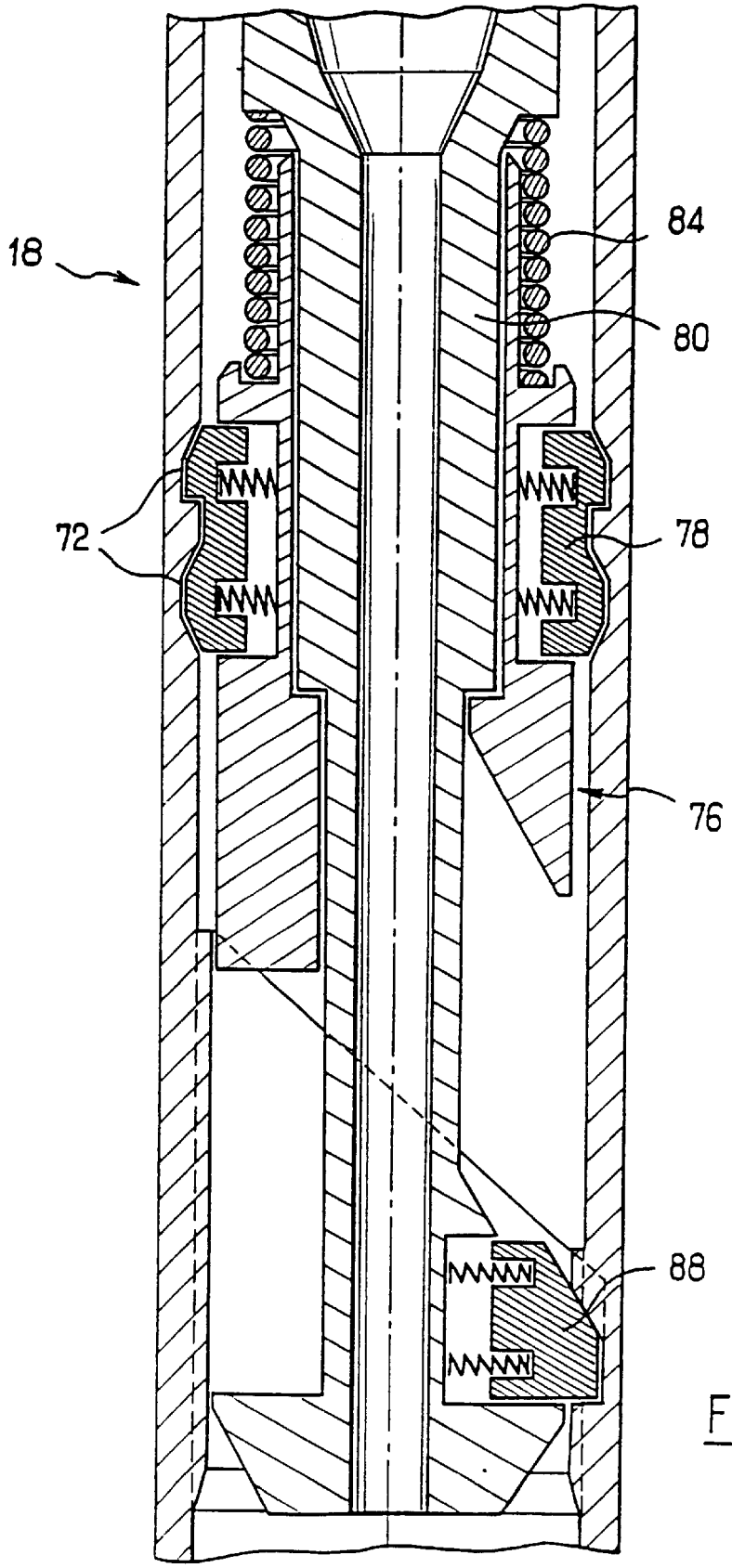

In the embodiment of FIG. 2, the body 26 was located and aligned in the body 18 by means of a conventional orienting means known as a J-slot. FIGS. 7A, 7B and 7C show elements of a second embodiment of orienting assembly which presents the advantage of leaving the casing bore free of any internal restriction over its whole length, as the locating lug is no longer required. The body 18 is formed, at a predetermined point below the desired opening 40, with a location region 70 comprising a number of recesses 72 set in the inner wall of the body 18. The particular disposition of the recesses 72 is associated with a given location region 70. At a predetermined point in the body below the location region 70 is formed a muleshoe 74. FIG. 7B shows a locating assembly 76 adapted to be received and located in the location region 70. The locating assembly 76 comprises a plurality of identical keys 78, arranged about a sleeve 79 which is slideably mounted on the outer surface of a central, cylindrical body 80, the keys being urged radially outwards into their illustrated position by springs 82. In use, the locating assembly 76 is lowered down, within the body 18 until it reacher the position illustrated in FIG. 7C in which the keys 78 engage the corresponding recesses 72 formed on the i surface of the body 18.. It should be noted that, since the keys 78 will only engage recesses 72 having the corresponding shape, the locating assembly can be lowered down the well, past location regions adapted to receive other locating assemblies, without the keys engaging the recesses and blocking the locating assembly in position. Thus, a given locating assembly will only seat itself in a predetermined, given location region in the body.

Once the locating assembly 76 has been seated in the predetermined location region, further downward motion will cause the cylindrical body 80 to slide axially relative to the sleeve 79, against the force of spring 84, into a position where the lower end 86 of the cylindrical body extends beyond the end of the sleeve 79. In this position, a locating lug 88, which is normally held closed and protected by the sleeve against the force of springs 90, is free to extend radially outwardly from the lower end 86 beyond the sleeve 79. From this position, further downward movement of the cylindrical body 80 will cause the locating lug 88 to engage a downwardly extending slot 92 in the mule shoe 74. Thus, the locating assembly 76 can be positioned at a predetermined point, and with a predetermined orientation, in the body 18. Having correctly positioned the locating assembly 76, it is a simple matter to locate the outlet 20 and the whipstock 28 at a desired position in the body, above the locating assembly. In order to prevent any possible movement of the assembly 76 and the whipstock 28 once they have been positioned inside the body, it is envisaged to fit the mandrel of the locating assembly 76 with a releasable anchoring device which would be located between the whipstock 28 and the locating assembly 76. Such an anchoring assembly would comprise a compressible rubber element which would prevent formation cuttings from being deposited in the recesses 72 set in the inner wall of the body 18.

Figure 8:
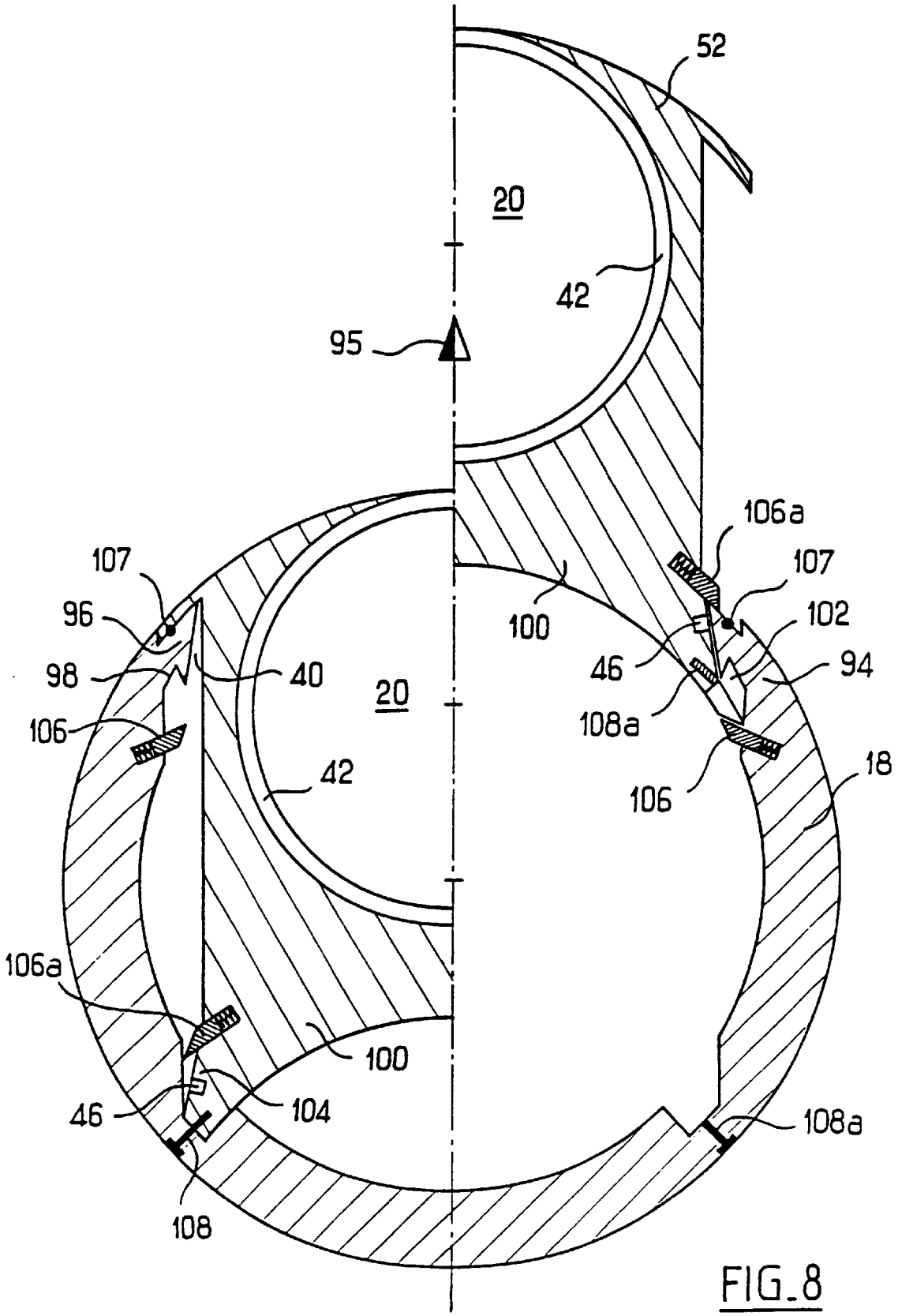
FIG. 8 is a combined cross-sectional view, corresponding to those of FIGS. 5*a* and 5*b*, of a second embodiment of apparatus according to the invention.

In FIG. 8, there is shown a second embodiment of an apparatus according to the invention which ensures that, when the outlet 20 is in its open position, the interior of the body 18 remains completely sealed with respect to the well, and, furthermore, ensures that the structural integrity of the body remains satisfactory.

In FIG. 8 it will be noted that the edge 96 of the opening 40 is formed with an internal recess 98 extending, in the wall of region 94, in the direction of opening of the outlet 20, as shown by arrow 95. A support 100, whose shape and size correspond to those of the opening 40, is formed with projecting lugs 102 which extend along its edges. When the outlet 20 is opened, and the support 100 moves to fill the opening 40, the projecting lugs 102 mate with the corresponding recesses 98. This interengagement between the support 100 and the wall of body 18 serves to strengthen the apparatus and make it more resistant to bursting. Furthermore, the edge 96 of the opening 40 extends at a slight angle, preferably 5°, to the direction of opening shown by arrow 95. The edge of support 100 is formed at a corresponding angle. This choice of angle assists in centering the support 100 in the opening 40. Instead of arranging the seal 46 along the outer surface of the support 100, as was the case in the embodiment of FIGS. 5*a* and 5*b*, the seal 46 extends along the edges 104 of the support 100. This has the advantage of protecting the seal from mechanical damage when the outlet is in its closed position. In addition, a spring mounted latch 106 is mounted along each side of the opening 40 in the wall of region 94 to ensure that the outlet 20 remains in its open position shown in FIG. 8*b*. A set of latches 106*a* could alternatively be mounted on the outer edge of the support 100.

In the embodiments of FIGS. 1 to 5, the outlets 20 were moved from their closed position to their open position by a tubular actuator 22 lowered down within the body from the surface. This actuator had an external diameter closely similar to the internal diameter of the body in order to ensure the complete displacement of the outlet into its open position. This necessarily close fit of the actuator in the body could result in the actuator becoming jammed during its descent into position. In order to overcome this problem, an alternative type of actuator can be used in which an inflatable packer of conventional design is arranged at the lower end of the drillstring having a considerably lesser diameter than that of the tubular actuator 22. Once the packer has been lowered into position, adjacent the outlet 20 to be opened, fluid pressure is applied to the interior of the packer, from the surface, by way of the drillstring. This pressure causes the packer to inflate, whereby its diameter considerably increases, pushing on the support 44;100 and opening the outlet. The packer can then be deflated, allowing it to be brought back up to the surface.

In the case where horizontal, or steeply inclined wells, traverse a layer of reservoir rock, it is desirable to drill several drains, each of which extend generally horizontally within the layer in order to produce a maximum quantity of oil from the reservoir. With the previously described embodiments of the invention, it is not always possible to align the outlet into the desired direction simply by orienting the casing into a predetermined angular position at the surface. This problem arises due to friction between the casing and the wall of the well. Thus, it is desirable to provide a way to allow the apparatus and, in particular, a given outlet, to be located in a predetermined angular position.

According to a further aspect of the invention, the body 18, containing at least one outlet 20, may form a separate sub-assembly. This sub-assembly is mounted on the lower end of the casing 14 by means of a swivel joint i.e. a joint which allows the sub-assembly to rotate, about its longitudinal axis, relative to the casing. The sub-assembly is fitted with an internal locating device, for example that shown in the embodiment of FIG. 7, which allows a locating member, arranged at the end of a drillstring lowered down within the casing, to fixedly engage the sub-assembly. Thus, once the end of the drillstring has interengaged the sub-assembly, rotation of the upper end of the drillstring at the surface will cause the sub-assembly to rotate relative to the casing and to its surroundings. Using conventional measurement-while-drilling techniques, which incorporate inertial and magnetic measuring devices, it is possible to determine the precise angular position of the sub-assembly and thus correctly move it into its desired, predetermined position by controlled rotation of the drillstring. A device known as a reversing tool, which is used for mechanical backing-off applications, may advantageously be incorporated between the drillstring and the sub-assembly. This device includes a planetary gearing system which, for example, transforms two rotations of the drillstring into one rotation of the sub-assembly. Such a system allows greater precision in the angular orientation of an outlet by rotation of the drillstring.

According to a still further aspect of the invention, an alternate means of causing the sub-assembly to rotate relative to the casing may be provided. This embodiment requires the reaming out of an enlarged volume 12 along a greater axial length than in previous embodiments. In this embodiment, the external surface of the sub-assembly is formed with one or more outwardly projecting helical blades or rails which extend, in the manner of an Archimedes screw, longitudinally along the sub-assembly. When the sub-assembly has been lowered into position, the edge of the blades come into contact with the wall of the well. Further axial displacement of the casing and the sub-assembly in either direction will be accompanied by a corresponding rotation of the sub-assembly which is brought about by the interengagement of the helical blades and the wall of the well. The precise angular position of the sub-assembly can be determined using conventional means as previously described.

When the assembly is lowered into the well there is a risk that the fluid pressure within the casing might inadvertently open the outlet. Thus, the outlet could advantageously be fitted with a locking means such as a shear pin 108 to hold it in its closed position. The actuator for the outlet would therefore further comprise means to release the locking means once the actuator is in its lowered position. Furthermore it is envisaged that the outlet 20 and its closure member 52 be formed from a single piece. This would further strengthen the assembly and make it more resistant to collapse. A seal 107 could also be incorporated between the closure member 52 and the edge 96 of the opening 40.

In order to give greater flexibility to the apparatus in accordance with the invention, it may advantageously be constructed from individual units, each containing a single outlet. Each individual unit would be connected to an adjacent unit by a sub-assembly. Thus, a composite body 18 could be assembled, for example on the drilling site, so as to comprise a desired number of outlets having a given axial separation and angular orientation.

It is envisaged that the apparatus of the present invention may be used with existing wells, that is wells already fitted with a conventional casing. In such a case the existing well's casing is section milled at the desired depth and undereamed to the appropriate diameter over the appropriate length. The body 18 of the apparatus is mounted on a short section of casing, having a diameter less than the internal diameter of the existing casing, which is hung into the existing well at the appropriate depth. An orienting assembly having a whipstock mounted on a cylindrical spacer is then lowered into the well by conventional means. The use of the apparatus in existing wells gives the advantage that it allows increased production in wells that might otherwise be declining in production.

It is further envisaged that the present apparatus be used with drill strings of reduced diameter, that is less than 12 cm, the dimensions of the apparatus being reduced accordingly.

We claim:

1. Multiple drain drilling and production apparatus (16) comprising a generally cylindrical casing (18) adapted to be located within a well, orienting means (24,28) adapted to be received in the casing (18) to deviate a drill string received within the casing, at a predetermined depth, from a path coaxial with the casing to a path at a predetermined angle to the axis of the casing, characterised in that the apparatus comprises at least one outlet means (20) comprising a generally tubular element (42) located within the casing and forming a part thereof and opening thereinto, and the generally tubular element being operatively associated with the casing to be displaceable from a first position generally coaxial with the casing, into a second position at a predetermined angle thereto, by an actuator (22) received within the casing, and the orienting means (24,28) being located adjacent the outlet means (20).

2. Apparatus according to claim 1 characterised in that the casing (18) is formed with an opening (40) for each outlet means, the apparatus further comprising seal means (46) arranged around the opening between each outlet means (20) and the casing (18).

3. Apparatus according to claim 2 characterised in that the casing (18) comprises an outer casing (48) mounted around the opening (40), each outlet means (20) being formed with a support (44) adapted to close the opening (40) when the outlet means is in its second position, the seal means (46) being located on the support (44).

4. Apparatus according to any one of claims 1 to 3 characterised in that the orienting means (24) comprises a whipstock (28), and a body (26,60) which is adapted to engage a locating lug (32) arranged within the casing (18) so as to locate the whipstock at a predetermined position within the casing (18).

5. Apparatus according to claim 1 further comprising three outlet means (20), each arranged with a predetermined orientation relative to the casing (18).

6. Apparatus according to claim 1 characterized in that the actuator (22) comprises a tube (22) received within the casing (18).

7. Apparatus according to claim 1 characterized in that the actuator (22) comprises an inflatable packer received within the casing (18).

8. Apparatus according to claim 3 characterised in that the casing comprises a closure member (52) for the opening (40) when the tubular element (42) is in its first position.

9. Apparatus according to claim 8 further comprising a seal between the outer casing (48) and the closure member (52).

10. Apparatus according to claim 1, further comprising:

an opening preformed in the casing; and the outlet means is operative to be displaceable through the opening.

11. Apparatus according to claim 1 characterized in that the generally tubular element (42) is retained in its second position by a spring mounted latch (106).

12. Apparatus according to claim 1 characterized in that the apparatus comprises a sub-assembly, adapted to be rotatably mounted on an end of a casing located within the well.

13. Multiple drain drilling and production apparatus (16) comprising a generally cylindrical casing (18) adapted to be located within a well, orienting means (24,28) adapted to be received in the casing (18) to deviate a drill string received within the casing, at a predetermined depth, from a path coaxial with the casing to a path at a predetermined angle to the axis of the casing and forming a part thereof and characterised in that the apparatus comprises at least one outlet means (20) comprising a generally tubular element (42) located within the casing and opening thereinto, and displaceable from a first position generally coaxial with the casing, into a second position at a predetermined angle thereto, by an actuator (22) received within the casing, the orienting means (24,28) being located adjacent the outlet means (20);

the casing (18) being formed with an opening (40) for each outlet means, the apparatus further comprising seal means (46) arranged around the opening between each outlet means (20) and the casing (18);

the casing (18) further comprising an outer casing (48) mounted around the opening (40), each outlet means (20) being formed with a support (44) adapted to close the opening (40) when the outlet means is in its second position, the seal means (46) being located on the support (44);

the casing (18) further comprising a closure member (52) for the opening (40) when the tubular element (42) is in its first position; and a seal made from fissile material between the outer casing (48) and the closure member (52).

* * * * *

UNITED STATES PATENT AND TRADEMARK OFFICE

CERTIFICATE OF CORRECTION

PATENT NO. : 5,915,474
DATED : June 29, 1999
INVENTOR(S) : Jean Buytaert, et al.

It is certified that error appears in the above-identified patent and that said Letters Patent is hereby corrected as shown below:

Title page,
Item [73] add -- Elf Acquitaine Production -- as a joint Assignee.

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 5,915,474
DATED : June 29, 1999
INVENTOR(S) : Jean Buytaert et al.

It is certified that error appears in the above-identified patent and that said Letters Patent is hereby corrected as shown below:

Title page,
Item [73], Assignee please change to -- Elf Aquitaine Production -- as joint Assignee.

Signed and Sealed this

Twenty-eighth Day of January, 2003

JAMES E. ROGAN
*Director of the United States Patent and Trademark Office*